US005607907A

United States Patent [19]

Watanabe et al.

[11] Patent Number: 5,607,907

[45] Date of Patent: Mar. 4, 1997

[54] MULTIPURPOSE FUNCTIONAL FLUID FOR AGRICULTURAL MACHINERY OR CONSTRUCTION MACHINERY

[75] Inventors: Hiroshi Watanabe, Matsudo; Michio Shiga, Hiratsuka; Satoshi Ohta, Ogasa-gun, all of Japan

[73] Assignee: Oronite Japan Limited, Japan

[21] Appl. No.: 321,495

[22] Filed: Oct. 12, 1994

[51] Int. Cl.[6] ..... C10M 129/74; C10M 137/14

[52] U.S. Cl. ..... 508/371; 508/455

[58] Field of Search ..... 252/56 R, 56 S, 252/79

[56] References Cited

U.S. PATENT DOCUMENTS

| | | | |
|---|---|---|---|
| 2,994,663 | 8/1961 | Lowe | 252/56 S |
| 3,000,827 | 9/1961 | Moler | 252/56 S |
| 3,441,600 | 4/1969 | Chao et al. | 260/488 |
| 3,655,559 | 4/1972 | Holt | 252/51.5 A |
| 3,694,382 | 9/1972 | Kleiman et al. | 252/56 S |
| 4,049,563 | 9/1977 | Burrous | 252/56 S X |
| 4,053,491 | 10/1977 | Koch et al. | 260/410.6 |
| 4,144,183 | 3/1979 | Koch et al. | 252/56 S |
| 4,175,046 | 11/1979 | Coant et al. | 252/56 S |
| 4,263,159 | 4/1981 | Berens et al. | 252/79 |
| 4,780,229 | 10/1988 | Mullin | 252/32.5 |
| 4,826,633 | 5/1989 | Carr et al. | 252/56 S |

FOREIGN PATENT DOCUMENTS

| | | | |
|---|---|---|---|
| 0103884A2 | 3/1984 | European Pat. Off. | C10M 3/20 |
| 0407977A1 | 1/1991 | European Pat. Off. | C10M 141/10 |
| 0523561A1 | 1/1993 | European Pat. Off. | C10M 169/04 |
| 986067 | 3/1965 | United Kingdom . | |
| 1189541 | 4/1970 | United Kingdom | C10M 3/28 |
| 1525392 | 9/1978 | United Kingdom | C10M 3/20 |
| 2063909A | 6/1981 | United Kingdom | C10M 3/28 |
| WO91/15455 | 3/1991 | WIPO | C07C 69/30 |

*Primary Examiner*—Stephen Kalafut
*Assistant Examiner*—Cephia D. Toomer
*Attorney, Agent, or Firm*—E. A. Schaal

[57] ABSTRACT

A biodegradable multipurpose functional fluid for agricultural or construction machinery, comprising a base oil, a detergent-dispersant and an antioxidant (and a viscosity index improver if desired), in which the base oil is a fatty acid triester of trimethylolpropane obtained from a fatty acid that either has from 40% to 70% by weight of caprylic acid and from 20% to 50% by weight of capric acid, or is derived from a coconut oil which has been adjusted to have a stearic acid content of from 10% to 20% by weight.

2 Claims, No Drawings

MULTIPURPOSE FUNCTIONAL FLUID FOR AGRICULTURAL MACHINERY OR CONSTRUCTION MACHINERY

The present invention relates to a multipurpose functional fluid for agricultural machinery or construction machinery, such as a multipurpose functional fluid for tractors. More particularly, the invention relates to a multipurpose functional fluid for agricultural machinery or construction machinery, that fluid showing good biodegradability and performance that is almost equal to that of conventional multipurpose functional fluids that use a mineral oil as base oil.

BACKGROUND OF THE INVENTION

Recently, multipurpose functional fluids have been used as lubricating hydraulic fluids for various construction machinery and agricultural machinery. The multipurpose functional fluids are used for lubrication of power transmission devices (e.g., speed change gear and differential gear), elevating operation parts of machine tools and hydraulic systems (e.g., power steering system), and for lubrication of engine systems and wet type brake systems. Conventionally employed multipurpose functional fluids are prepared by compounding a mineral oil as a base oil with a detergent dispersant and an antioxidant and, if necessary, a viscosity index improver and other additives.

In recent years, lubricating fluids that leak from various machinery or waste lubricating oils cause problems of environmental pollution. For example, pollution of lake or sea is caused by two-stroke-cycle engine oils for motorboats. Waste pollution is caused by two-stroke-cycle engine oils for machine tools, such as those for chain saws. To cope with the pollutions, studies were made of the use of a fatty acid triglyceride having good biodegradability, e.g., a vegetable oil, as the base oil in place of the mineral oil. Studies are now being made of the use of two-stroke-cycle engine oils containing fatty acid triglyceride as the base oil.

Research has been made for the improvement of the biodegradability of hydraulic fluids. Studies in the field of hydraulic fluids include the use of fatty acid triglyceride having good biodegradability, such as a vegetable oil. See: SAE Technical Paper No. 910960, Apr. 9–10, 1991).

The present inventors have studied the use of a vegetable oil as the base oil in place of the mineral oil in accordance with technical information obtained so far. However, they have concluded that a multipurpose functional fluid using a vegetable oil as the base oil has insufficient stability, particularly in the oxidation stability.

The use, in lubricating products, of base oils other than mineral oils for their biodegradibility is well known. Synthetic ester base oils or naturally occurring ester mixtures such as vegetable oils provide lubricating ability and biodegradability to a lubricant formulation. A British patent, 1,189,541, published 29 Apr., 1970, teaches that esters of saturated aliphatic carboxylic acids using alcohols of at least five carbon atoms are usable as base oils for transmission lubricants. An European patent application, 0 103 884, published 28 Mar., 1984, teaches that esters of polyols and carboxylic acids are useful for transmission lubricants. There are other literature sources that teach the use of many different types of synthetic ester base oils as suitable for hydraulic fluid and transmission fluid base oils.

Among the large variety of ester base oils which have lubricity and biodegradability, however, there is a much smaller variety which can also be compatible with the additives used to provide the equipment performance lacking in the base oil itself. These additives provide oxidation resistance, rust prevention, brake chatter prevention, water tolerance, etc., which are not sufficient in the base oil alone. A class of such additives, useful for making multipurpose functional fluids, is not soluble in every ester base oil otherwise suitable based on its lubricity and biodegradability. In this invention, we have discovered those combinations of multipurpose functional fluid additive and ester base oil which also are compatible and allow a practical product to be formulated.

SUMMARY OF THE INVENTION

The present invention provides a multipurpose functional fluid for agricultural machinery or construction machinery that has excellent brake chatter performance in a wet-brake system. That multipurpose functional fluid has a specific fatty acid triester of trimethylolpropane as base oil, a detergent-dispersant and an antioxidant. Optionally, the multipurpose functional fluid can have a viscosity index improver.

There are two types of fatty acid triester of trimethylolpropane that work well in the present invention. One type of fatty acid triester of trimethylolpropane is obtained from a fatty acid comprising from 40% to 70% by weight of caprylic acid, and from 20% to 50% by weight of capric acid. Preferably, the content of the caprylic acid is higher than the content of the capric acid.

Another type of fatty acid triester of trimethylolpropane is obtained from a fatty acid derived from a coconut oil which has been adjusted to have a stearic acid content of from 10% to 20% by weight.

It is an object of the present invention to provide a multipurpose functional fluid for agricultural machinery or construction machinery, which shows not only good biodegradability but also shows performance, particularly oxidation stability, almost equal to that of conventional hydraulic fluids for construction machinery which use a mineral oil as the base oil.

DETAILED DESCRIPTION OF THE INVENTION

The present invention resides in a multipurpose functional fluid for agricultural machinery or construction machinery, comprising a base oil, a detergent-dispersant and an antioxidant, in which a fatty acid triester of trimethylolpropane is used as the base oil. That multipurpose functional fluid also can comprise a viscosity index improver.

The fatty acid triester of trimethylolpropane can be prepared by esterifying trimethylolpropane and a fatty acid or a mixture of fatty acids by a conventional process. The fatty acid triester of trimethylolpropane used in the invention is an ester obtained by using a fatty acid of 6 or more carbon atoms as the fatty acid, and most of the fatty acids are preferably those having 8 or more carbon atoms. It is preferred that the total amount of the fatty acid having 8 carbon atoms and the fatty acid having 10 or more carbon atoms is not less than 80% by weight based on the whole amount of all the fatty acids.

Two specific types of fatty acids can be used. The first type of fatty acid contains mainly a saturated fatty acid of 6 to 14 carbon atoms and in which a caprylic acid (carbon atom content: 8) and a capric acid (carbon atom content: 10) both are contained in amounts of 40 to 70% by weight and 20 to 50% by weight, respectively. The second type of fatty acid is derived from a coconut oil which has been adjusted to have a stearic acid content of from 10% to 20% by weight.

Among the large variety of ester base oils which have lubricity and biodegradability, there is a limit variety which can also be compatible with the additives used to provide the equipment performance lacking in the base oil itself. These additives provide oxidation resistance, rust prevention, brake chatter prevention, water tolerance, etc., which are not sufficient in the base oil alone. A class of such additives, useful for making multipurpose functional fluids, is not soluble in every ester base oil otherwise suitable based on its lubricity and biodegradability. In this invention, we have discovered those combinations of multipurpose functional fluid additive and ester base oil which also are compatible and allow a practical product to be formulated.

Though the base oil used for the multipurpose functional fluid of the invention is preferably made of only the fatty acid triester of trimethylolpropane, other known base oil materials, such as mineral oils, vegetable oils and polyalkylene glycol, can be added thereto as far as the amount of the added materials is less than 50% by weight, particularly less than 20% by weight, based on the whole amount of the base oil.

A detergent-dispersant such as metal sulfonate and an antioxidant such as zinc dialkyldithtophosphate are added to the base oil. If necessary, a viscosity index improver such as poly(methyl methacrylate) can also be added.

A variety of detergent-dispersants, antioxidants and viscosity index improvers are known as those for multipurpose functional fluids. These known materials or their analogous compounds can be used for preparing the multipurpose functional fluid of the invention. Some typical examples of these materials are described below.

As the detergent dispersant, a metal phenate or a metal sulfonate is generally used. The metal phenate is an alkaline earth metal salt of sulfide of alkylphenol having an alkyl group of about 8 to 30 carbon atoms. In this case, alkaline earth metals generally used are calcium, magnesium and barium. The metal sulfonate is an alkaline earth metal salt of sulfonate of a mineral oil having a molecular weight of about 400 to 600 or an alkaline earth metal salt of sulfonate of an alkyl-substituted aromatic compound. Also in this case, alkaline earth metals generally used are calcium, magnesium and barium. The metal phenate and the metal sulfonate can be used singly or in combination. Also employable are metallic detergents (metal-containing detergents) such as salicylates, phosphonates, and naphthenates of alkaline earth metals. They can be used singly or in combination with the above-mentioned phenate or sulfonate. These metal-containing detergents can be of either a neutral type or an over-based type having a base number of 150 to 300 or more. If desired, detergent-dispersants of ashless type (which may contain boron) can be used singly or in combination.

The detergent-dispersant is generally incorporated into the multipurpose functional fluid in an amount of 0.05 to 10% by weight per total amount of the multipurpose functional fluid.

As the antioxidant, zinc dialkyldithiophosphate (also referred to simply as "zinc dithiophosphate" or "Zn-DTP") is generally used. Zn-DTP functions as not only an antioxidant but also an antiwear agent. Preferably used as the Zn-DTP is zinc dihydrocarbyldithiophosphate generally having an alkyl group of to 18 carbon atoms or an alkylaryl group having an alkyl group of 3 to 18 carbon atoms. The antioxidant is generally incorporated into the multipurpose functional fluid in an amount of 0.1 to 3% by weight per total amount of the multipurpose functional fluid.

Examples of the viscosity index improvers generally used include polyalkyl methacrylate, an ethylene/propylene copolymer, a styrene/butadiene copolymer and polyisoprene. Also employable are viscosity index improvers of dispersant type (having increased dispersancy) or multifunction type. These viscosity index improvers can be used singly or in combination. The amount of the viscosity index improver to be incorporated into the multipurpose functional fluid varies with desired viscosity of the target hydraulic fluid, and generally is in the range of 1 to 20% by weight per total amount of the multipurpose functional fluid.

The viscosity index improver used for the multipurpose functional fluid of the invention is preferably prepared using as a polymerization reaction solvent a fatty acid triester of trimethylolpropane, which is a base a oil material of the invention, or a mixture thereof with other base oil material, and polymerizing a monomer such as methacrylate (starting material) in the solvent. The viscosity index improver solution thus obtained (preferably having a concentration of 5 to 20% by weight) can be easily incorporated into multipurpose functional fluids, and hence the incorporation work ability can be improved.

The multipurpose functional fluid of the invention can contain various auxiliary additives in addition to the components described above, if desired. Examples of such auxiliary additives include known antioxidants, extreme pressure agents, corrosion inhibitors, rust inhibitors, friction modifiers, antifoaming agents and pour point depressants. Further, antiwear improving agents and multifunction type additives (e.g., organic molybdenum compounds such as molybdenum dithiophosphate) can be used in combination with the above components.

In the preparation of the multipurpose functional fluid of the invention, each additives can be added separately to a base oil. However, the multipurpose functional fluid is preferably prepared by a process of dissolving the viscosity index improver in a portion of the base oil to beforehand to prepare a viscosity index improver solution (that is, the viscosity index improver is subjected to polymerization reaction in the base oil as is described before to prepare the solution) and then mixing the solution with other portion of the base oil, the detergent-dispersant, the antioxidant and other additives.

EXAMPLES

The invention will be further illustrated by following examples, which set forth particularly advantageous method embodiments. While the Examples are provided to illustrate the present invention, they are not intended to limit it.

Two kinds of hydraulic fluids for tractor I, II, III and IV according to the invention and two kinds of hydraulic fluids A and B for comparison were prepared.

EXAMPLE I (KINEMATIC VISCOSITY AT 100° C.: 7.2 CST)

The base oil was a triester of trimethylolpropane and fatty acid derived from coconut oil; content of stearic acid component in the fatty acid: increased to not less than 14 wt. %. The calcium sulfonate was a mixture of over-based type and neutral type.

Base oil: 93.7 wt. %

Calcium sulfonate 4.2 wt. %

Zn-DTP: 1.6 wt. %

Friction modifier: 0.5 wt. %

Antifoaming agent: 10 ppm

EXAMPLE II (KINEMATIC VISCOSITY AT 100° C.: 13.5 CST)

The base oil was a triester of trimethylolpropane and fatty acid derived from coconut oil; content of stearic acid component in the fatty acid: increased to not less than 14 wt. %. The calcium sulfonate was a mixture of over-based type and neutral type. Viscosity index improver was a polymethacrylate solution prepared by using the above triester type base oil as a reaction solvent; concentration of the solution is 10 wt. %.

Base oil: 83.7 wt. %

Calcium sulfonate: 4.2 wt. %

ZnDTP: 1.6 wt. %

Friction modifier: 0.5 wt. %

Antifoaming agent: 10 ppm

Viscosity index improver: 10 wt. %

EXAMPLE III (KINEMATIC VISCOSITY AT 100° C.: 4.4 CST)

The base oil was a triester of trimethylolpropane and saturated fatty acid; composition of the fatty acid: caprylic acid=61 wt. %, capric acid=35 wt. %, lauric acid=4 wt. %. The calcium sulfonate was a mixture of over-based type and neutral type.

Base oil: 93.7 wt. %

Calcium sulfonate: 4.2 wt. %

Zn-DTP: 1.6 wt. %

Friction modifier: 0.5 wt. %

Antifoaming agent: 10 ppm

EXAMPLE IV (KINEMATIC VISCOSITY AT 100° C.: 9.0 CST)

The base oil was a triester of trimethylolpropane and saturated fatty acid; composition of the fatty acid: caprylic acid=61 wt. % , capric acid=35 wt. %, lauric acid=4 wt. %. The calcium sulfonate was a mixture of over-based type and neutral type. The viscosity index improver was a polymethacrylate solution prepared by using the above triester type base oil as a reaction solvent; concentration of the solution is 10 wt. %.

Base oil: 83.7 wt. %

Calcium sulfonate: 4.2 wt. %

Zn-DTP: 1.6 wt. %

Friction modifier: 0.5 wt. %

Antifoaming agent: 10 ppm

Viscosity index improver: 10 wt. %

COMPARATIVE EXAMPLE A (KINEMATIC VISCOSITY AT 100° C.: 10.3 CST)

The base oil was a coconut oil:fatty acid triglyceride. The calcium sulfonate was a mixture of over-based type and neutral type. The viscosity index improver was a polymethacrylate solution prepared by using the above coconut oil as a reaction solvent; concentration of the solution: 10 wt. %.

Base oil: 83.7 wt. %

Calcium sulfonate: 4.2 wt. %

Zn-DTP: 1.6 wt. %

Wear reducing agent: 0.5 wt. %

Antifoaming agent: 10 ppm

Viscosity index improver: 10 wt. %

COMPARATIVE EXAMPLE B (KINEMATIC VISCOSITY AT 100° C.: 9.0 CST)

The base oil was a refined mineral oil. The calcium sulfonate was a mixture of over-based type and neutral type. The viscosity index improver was a polymethacrylate solution.

Base oil: 83.7 wt. %

Calcium sulfonate: 4.2 wt. %

Zn-DTP: 1.6 wt. %

Friction modifier: 0.5 wt. %

Antifoaming agent: 10 ppm

Viscosity index improver: 10 wt. %

EVALUATION OF HYDRAULIC FLUIDS

The hydraulic fluids I, II, III, IV, A and B obtained in the above were evaluated on the basic performance as a hydraulic fluid. The results are as follows.

| Test items | I | II | III | IV | A | B |
|---|---|---|---|---|---|---|
| Gear wear | Pass | Pass | Pass | Pass | Pass | Pass |
| Pump wear | Pass | Pass | Pass | Pass | Pass | Pass |
| Brake creak | Pass | Pass | Pass | Pass | Pass | Pass |
| Oxidation stability | Pass | Pass | Pass | Pass | Fail | Pass |
| Biodegradability | Pass | Pass | Pass | Pass | Pass | Fail |
| Compatibility with additives | Pass | Pass | Pass | Pass | Fail | Pass |

The above-mentioned tests were carried out by the following methods.

Gear Wear Test

The gear test was performed in accordance with the test method ASTM-D-4998 using a FZG gear rig test machine. When the wear amount (based on the amount before the test) of the gear after the test was not more than 100 mg, the hydraulic fluid used was marked acceptable. When the wear amount thereof was more than 100 mg, the hydraulic fluid used was marked fail.

Pump Wear Test

The pump test was performed in accordance with the test method ASTM-D-2882 using a vane pump test machine, (V104C type of Vickers Co.). When the total of the wear amounts (based on the amount before the test) of the vane and the cam ring was not more than 100 mg, the hydraulic fluid used was marked acceptable. When the total of the wear amounts thereof was more than 100 mg, the hydraulic fluid was marked fail Brake Creak Test In the brake creak test, a Yammer tractor FX-195D and a Kubota tractor A-19 were used, and occurrence of brake creak was examined by adding 0.3 vol. % of water to the hydraulic fluid. When any brake creak did not occur, the hydraulic fluid used was marked acceptable. When brake creak occurred, the hydraulic fluid used was marked fail.

Oxidation Stability

The oxidation stability was examined in accordance with the lubricating oil oxidation stability test method JIS-K-2514 defined by Japanese Industrial Standard. The hydraulic fluid satisfying the following requisites was marked acceptable, while the hydraulic fluid not satisfying them was marked fail.

Test conditions: 150° C., 96 hours.

Requirements:

Viscosity increase of more than 10% is not observed after the test.

Production of strong acid is not observed.

Sludge is not observed.

Sedimentation of additives is not observed.

Biodegradability Test

The biodegradability test was performed in accordance with the CEC-L-33-T-82 test method defined by CEC (Coordination European Council). The hydraulic fluid showing a biodegradability of not less than 80% was marked acceptable, while the hydraulic fluid other than this was marked fail.

Compatibility with Additives

After the hydraulic fluid was prepared, it was allowed to stand at room temperature to observe tendency of turbidity with time. When any turbidity or sedimentation was not observed after 3 months, the hydraulic fluid used was marked acceptable. When turbidity or sedimentation was observed, the hydraulic fluid used was marked fail.

A class of such additives, useful for making multipurpose functional fluids, is not soluble in every ester base oil otherwise suitable based on its lubricity and biodegradability. This is shown below in Comparative Examples C through F, which all failed the compatibility with additives test described above.

COMPARATIVE EXAMPLE C (KINEMATIC VISCOSITY AT 100° C.: 6.0 CST)

The base oil was a diester of neopentylglycol and fatty acid; composition of the fatty acid: oleic acid=100 wt. %. The calcium sulfonate was a mixture of over-based type and neutral type.

Base oil: 93.7 wt. %

Calcium sulfonate: 4.2 wt. %

Zn-DTP: 1.6 wt. %

Friction modifier: 0.5 wt. %

Antifoaming agent: 10 ppm

COMPARATIVE EXAMPLE D (KINEMATIC VISCOSITY AT 100° C.: 6.0 CST)

The base oil was a triester of trimethylolpropane and fatty acid; composition of the fatty acid: oleic acid=100 wt. %. The calcium sulfonate was a mixture of over-based type and neutral type.

Base oil: 93.7 wt. %

Calcium sulfonate: 4.2 wt. %

Zn-DTP: 1.6 wt. %

Friction modifier: 0.5 wt. %

Antifoaming agent: 10 ppm

COMPARATIVE EXAMPLE E (KINEMATIC VISCOSITY AT 100° C.: 5.6 CST)

The base oil was a tetraester of pentaerythritol and fatty acid; composition of the fatty acid: caprylic acid=100 wt. %. The calcium sulfonate was a mixture of over-based type and neutral type.

Base oil: 93.7 wt. %

Calcium sulfonate: 4.2 wt. %

Zn-DTP: 1.6 wt. %

Friction modifier: 0.5 wt. %

Antifoaming agent: 10 ppm

COMPARATIVE EXAMPLE F (KINEMATIC VISCOSITY AT 100° C.: 12.6 CST)

The base oil was a tetraester of pentaerythritol and fatty acid; composition of the fatty acid: oleic acid=100 wt. %. The calcium sulfonate was a mixture of over-based type and neutral type.

Base oil: 93.7 wt. %

Calcium sulfonate: 4.2 wt. %

Zn-DTP: 1.6 wt. %

Friction modifier: 0.5 wt. %

Antifoaming agent: 10 ppm

Comparative Examples C through F, which all failed the compatibility with additives test described above.

Since the multipurpose functional fluid for agricultural machinery or construction machinery according to the invention uses an ester type oil as a base oil, it is highly biodegradable and shows satisfactory performance in various characteristics including oxidation stability required for multipurpose functional fluids for agricultural machinery or construction machinery. Hence, the multipurpose functional fluid of the invention can be used as a highly practical multipurpose functional fluid with reduction of environmental pollution.

While the present invention has been described with reference to specific embodiments, this application is intended to cover those various changes and substitutions that may be made by those skilled in the art without departing from the spirit and scope of the appended claims.

What is claimed is:

1. A multipurpose functional fluid for agricultural machinery or construction machinery, said functional fluid comprising a base oil, 0.05% to 10% by weight of a detergent-dispersant and 0.1% to 3% by weight of zinc dialkyldithiophosphate, wherein the base oil consists of a fatty acid triester of trimethylolpropane obtained from a fatty acid selected from the group consisting of:

(a) a fatty acid comprising:

(1) from 40% to 70% by weight of caprylic acid, and (2) from 20% to 50% by weight of capric acid; and (b) a fatty acid derived from a coconut oil which has been adjusted to have a stearic acid content of from 10% to 20% by weight.

2. A multipurpose functional fluid for agricultural machinery or construction machinery, said functional fluid consisting essentially of:

(a) a base oil consisting of a fatty acid triester of trimethylolpropane obtained from a fatty acid selected from the group consisting of:

(1) a fatty acid comprising:

(a) from 40% to 70% by weight of caprylic acid, and (b) from 20% to 50% by weight of capric acid; and (2) a fatty acid derived from a coconut oil which has been adjusted to have a stearic acid content of from 10% to 20% by weight, (b) 0.05% to 10% by weight of a detergent-dispersant, (c) 0.1% to 3% by weight of zinc dialkyldithiophosphate, and (d) 1% to 20% by weight of a viscosity index improver.

* * * * *